United States Patent [19]

Kawaguchi

[11] 4,274,209

[45] Jun. 23, 1981

[54] APPARATUS FOR IMPROVED AFTERTREATMENT OF TEXTILE MATERIAL BY APPLICATION OF MICROWAVES

[75] Inventor: Bunshire Kawaguchi, Kyoto, Japan

[73] Assignee: The Ichikin, Ltd., Japan

[21] Appl. No.: 107,790

[22] Filed: Dec. 28, 1979

[51] Int. Cl.[3] ..... F26B 3/34

[52] U.S. Cl. ..... 34/1; 34/68; 219/10.55 R; 219/10.55 M; 68/5 C; 68/5 E; 68/13 R

[58] Field of Search ..... 34/1, 18, 68, 153, 210, 34/216, 155; 68/5 C, 5 D, 5 E, 13 R; 219/10.55 R, 10.55 A, 10.55 M

[56] References Cited

U.S. PATENT DOCUMENTS

| | | | |
|---|---|---|---|
| 3,718,082 | 2/1973 | Lipoma | 219/10.55 A |
| 3,894,410 | 7/1975 | Fleissner | 68/5 D |
| 4,017,258 | 4/1977 | Sando et al. | 68/5 E |
| 4,182,946 | 1/1980 | Wayne et al. | 219/10.55 A |

*Primary Examiner*—Larry I. Schwartz

*Attorney, Agent, or Firm*—Lerner, David, Littenberg & Samuel

[57] ABSTRACT

For improved treatment of textile material after scouring or dyeing by application of microwaves, a preparatory heating chamber replete with steam is arranged for passage of the textile material substantially in a sheet form, and, is accompanied with a downstream microwave irradiation chamber of a confined construction replete with steam in which microwaves are applied to the textile material in the form of a rotating roll. Ideal aftertreatment can be carried out uniformly throughout the textile material at high thermal efficiency without any leakage of microwaves and steam.

4 Claims, 2 Drawing Figures

APPARATUS FOR IMPROVED AFTERTREATMENT OF TEXTILE MATERIAL BY APPLICATION OF MICROWAVES

BACKGROUND OF THE INVENTION

The present invention relates to apparatus for improved aftertreatment of textile material by application of microwaves, and more particularly relates to a novel apparatus used for improvement in effective drying of scoured or dyed textile material by means of irradiation of microwaves.

Fixing and development of dyes on dyed textile material have long been carried out by means of steaming the dyed textile material after interposed drying.

As a substitute for the steaming process, it has recently been proposed to apply microwaves to dyed textile material in wet state. Here, the word "microwaves" refers to electromagnetic waves whose frequencies are in a range from 300 to 30,000 MHz.

Microwaves have a number of notable merits in particular when they are used in treatment of textile material in wet state. Firstly, they permeate into the textile material extremely quickly and heat it within a very short time. Secondly, since generation of heat by microwave application is caused by dielectric loss, the microwaves are selectively absorbed in objects with large dielectric loss and heat the necessary or desired object only whilst avoiding heating of the unnecessary or undesired object or objects. Thirdly, the treated textile material generates heat by itself when subjected to microwave irradiation and the heat so generated warms the ambient atmosphere. Consequently, there is no need at all for any additional heating equipment which should otherwise be used for raising the temperature of the ambient atmosphere. This automatic generation of heat by the textile material assures a high rate of thermal efficiency in the process. Fourthly, since the microwaves cause a simultaneous temperature rise at different sections of the treated material, difference in temperature between the core and surface sections of the material is very small, thereby assuring ideally uniform heating of the material. Fifthly, the heating condition in the process can simply and freely be controlled in accordance with requirements in the actual treatment by adjustment of the output voltage used for microwave generation.

Irradiation of microwaves onto a textile material causes ionic conduction and dipole rotation of the fibers composing the textile material and water and/or agents contained in the materials and such ionic conduction and dipole rotation will cause rapid and uniform heating of the textile material.

A wide variety of systems have been proposed in order to practice the above-described microwave irradiation in treatment of textile materials, but quite a few of them have not been feasible on a practical industrial scale.

One cause for this difficulty resides in the manner of irradiation of microwaves. An applicator is generally used for this purpose and the conventional applicators are roughly classified into these types, i.e. an applicator with a hairpin curved waveguide, an applicator with a densely hairpin curved waveguide, and an oven-type applicator.

In the case of the applicator using the waveguide, heating effect is greatly affected by wave length of the microwave irradiated and this delicate influence tends to cause uneven heating of the material subjected to the treatment. Consequently, the applicators of these types are unsuited for treatment of dyed or scoured textile materials, which required a high rate of uniformity in the heating effect.

In the case of the oven-type applicator including a metallic hexahedral irradiation chamber, it is necessary to employ any expedient to equalize the strength of the magnetic field surrounding the material in the chamber. Otherwise, the applicator of this type is quite unsuited for use on practical industrial scale although it may operate in order in laboratories.

The other cause for the above-described difficulty resides in fusion of fibers composing a textile material during, or as a result of, heating by application of microwaves. This is in particular a serious problem when the textile material is composed of thermoplastic synthetic fibers such as acrylic fibers. Such fusion of the textile material is caused by a temperature rise of the water used as a dyeing medium and/or of a high boiling point agent or agents as assistants, both being contained in the textile material after dyeing. For example, in the case of a textile material made of acrylic fibers which can be dyed at a temperature close to the boiling point of pure water, swelling of the dyed fibers starts at a temperature close to 100° C. and, regardless of its dielectric constant, dipole rotation occurs in the fibers, which causes abrupt evacuation of water, temperature rise and eventual fusion of the fibers. In order to prevent such fusion of fibers composing the textile material, it is absolutely necessary to prevent evacuation of water contained in the fibers during the treatment.

A further cause for the above-described difficulty resides in the manner to prevent the above-described evacuation of water contained in the fibers during the treatment. For this effect, a textile material is transported through a microwave applicator zone or zones while being clamped between a pair of running endless belts or being placed in surface contact with a wet sheet. In either case, possible contamination on the belts or sheet tends to develop blemishes on the textile material, which greatly degrades its commercial value.

SUMMARY OF THE INVENTION

It is one object of the present invention to provide a novel apparatus for ideal aftertreatment of textile material by application of microwaves with a highly uniform heating effect.

It is another object of the present invention to provide a novel apparatus for successful aftertreatment of textile material by application of microwaves without causing any accidental fusion of fibers composing the material during the treatment.

It is a still further object of the present invention to provide a novel apparatus for advantageous aftertreatment of textile material by application of microwaves without development of any blemish on the treated material.

It is a further object of the present invention to provide a novel apparatus for economical aftertreatment of textile material by application of microwaves with simple construction in equipment.

In accordance with the basic aspect of the present invention, a preparatory heating chamber is arranged on the travelling course of a textile material, which the material travels through. Further, an almost confined microwave irradiation chamber is arranged on the downstream side of the preparatory heating chamber, in which means for winding up the introduced textile material into a roll, means for positively rotating the roll, an applicator of the microwaves, and means for steaming the interior of the irradiation chamber are arranged. The inlet to the irradiation chamber is properly sheltered in order to block accidental leakage of the steam and microwaves prevailing within the chamber.

DESCRIPTION OF THE PREFERRED EMBODIMENTS

It should be understood that, although the following description is focussed upon treatment of dyed textile material, the present invention is equally appliable to treatment of scoured textile material.

Figure 1:
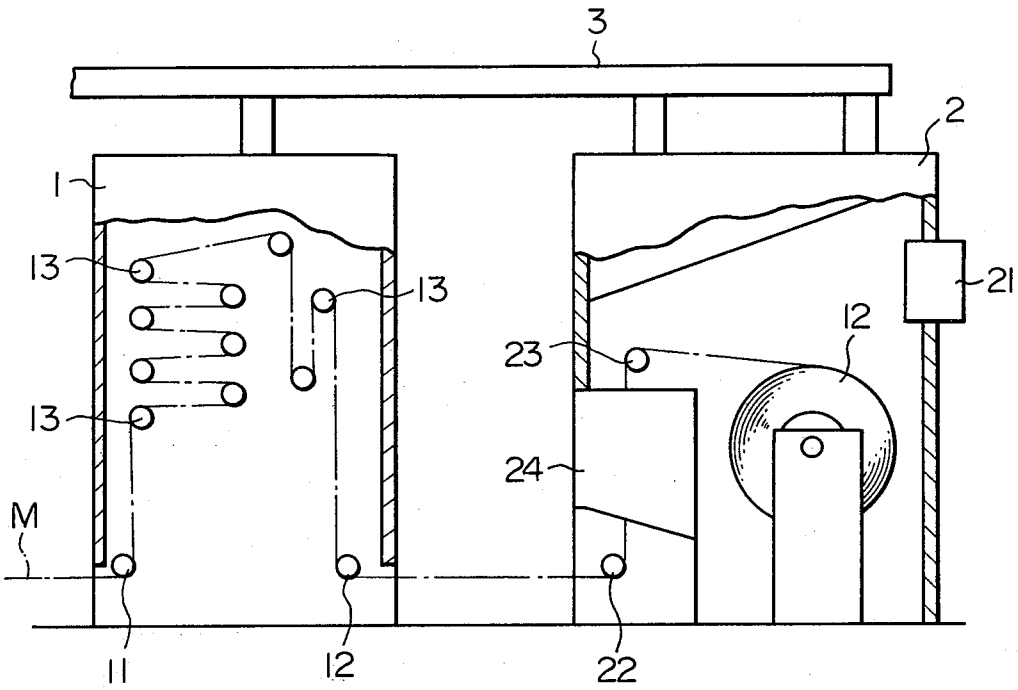
FIG. 1 is a side view, partly in section, of an embodiment of the apparatus in accordance with the present invention.

A basic embodiment of the apparatus in accordance with the present invention is shown in FIG. 1, in which the apparatus includes, as major elements, a preparatory heating chamber 1 and a microwave irradiation chamber 2 arranged in sequence along the travelling course of a textile material M.

It should be understood that the present invention is well applicable to treatment of a textile material of any form. It may be a woven cloth, a knitted cloth or flat sheet of threads arranged side-by-side relationship.

It should be further understood that the present invention is well applicable to treatment of a textile material dyed in any manner. It may be dyed by winch dyeing, jigger dyeing, beam dyeing, pad winch process, pad jig process, pad batch process, pad steam process, or screen or roll printing.

It should be further understood that the present invention is well applicable to treatment of a scoured or dyed textile material made of any fibers including natural, regenerated and synthetic fibers, although it is most advantageously applied to treatment of a textile material made of synthetic fibers.

Chambers 1 and 2 are both connected to a steam pipe 3 for feeding steam of a proper pressure to their interiors.

The preparatory heating chamber 1 is internally provided with a feed guide roller 11 arranged near its inlet, a delivery guide roller 12 arranged near its outlet, and a number of intermediate guide rollers 13 arranged in the zone between the two rollers 11 and 12. The number and arrangement of the intermediate guide rollers 13 can be freely designed depending on the length required for the travelling path of the textile material through the camber 1.

Preparatory heating should be applied to the textile material in a wet state. In application of the present invention, the preparatory heating has its particular significance when the textile material is made of synthetic fibers such as polyamide, polyester and acrylic fibers, since such fibers are liable to fuse during the treatment depending on the length of the treatment and the output power of the microwaves.

In the case of hydrophilic fibers such as cellulose fibers, colour fixing starts within several seconds after initiation of microwave irradiation and its dyeing affinity arrives at the highest value within about 20 seconds. In contrast to this, hydrophobic fibers such as polyamide fibers require microwave irradiation over a period of 5 minutes or longer. This is a result of the fact that a relatively long time is required to cause swelling of the textile material to a sufficient extent to allow appreciable diffusion of dyes into the fibers composing the textile material. However, as described already, long irradiation of microwaves on a textile material inevitably causes fusion of the fibers composing the textile material.

In order to obviate such problems, it may be thought to employ relatively long irradiation of microwaves with a relatively low output power of the microwaves. But, such a long irradiation degrades the basic merit of treatment by application of microwaves, i.e. rapid processing.

In accordance with the present invention, the preparatory heating preceding the microwave irradiation causes appreciable, though not enough, swelling of the textile material, thereby enabling relatively short microwave irradiation for diffusion of dyes.

The microwave irradiation chamber 2 is provided with a microwave applicator 21 electrically connected in a known manner to a microwave generator (not shown). The textile material M introduced into the chamber 2 is wound up into a roll R via a feed guide roller 22 and an intermediate guide roller 23. A known driving mechanism is arranged in order to rotate the roll R following any programmed sequence including positive rotation after complete winding-up.

The winding-up speed of the textile material is in a range from 50 to 100 meters per minute and the length of a unit textile material is about 2,000 meters for a unit weight of 100 g/m$^2$, and about 1,000 meters for a unit weight of 200 g/m$^2$.

A microwave generator of a maximum output power of 10 KW at 2450 MHz frequency may be used. Oscillation of microwaves is carried out by two sets of water-cooling type magnetrons of 5 KW output power. Any known type of waveguide may be used as long as it assures uniform irradiation of the microwaves on the textile material in the roll form.

The microwave irradiation should be carried out under saturation of the chamber 2 with steam. In case any animal fiber such as wool is to be treated, high pressure steam of about 4 kg/cm$^2$ should preferably be introduced into the chamber 2.

Figure 2:
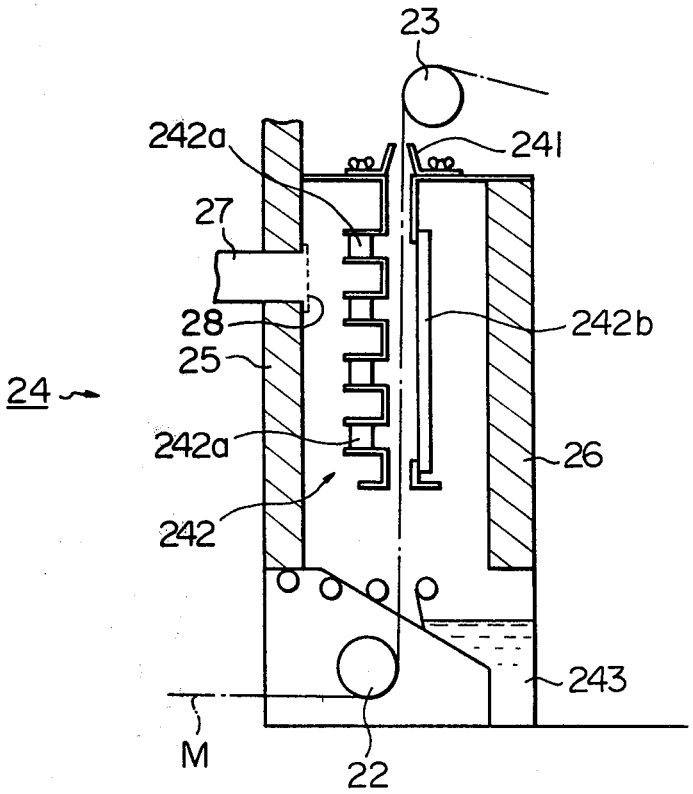
FIG. 2 is an enlarged side sectional view of the sheltered construction of the inlet used in the apparatus shown in FIG. 1.

Consequently, the interior of the irradiation chamber 2 is replete with microwaves and steam during the treatment. In order to prevent accidental leakage of the microwaves and the steam outside the chamber 2 whilst allowing free introduction of the textile material M into the chamber, a particular shelter construction 24 is arranged in the zone between the feed and intermediate rollers 22 and 23, which is shown in detail in FIG. 2.

The shelter construction is arranged within a space defined by a pair of relatively thick vertical walls 25 and 26 which prevent depositing of dews on the construction. The outer wall 25 is provided with a ventilation duct 27 whose inner opening is covered with a perforated plate 28 for preventing leakage of electric waves via the duct 27. The top of the space is covered by an adjustable slit plate 241 whose opening is freely adjustable in size in accordance with the processing conditions. A blocking filter 242 is arranged vertically below the slit plate 241, which includes a plurality of electric wave damping elements **242*a* aligned vertically whilst facing the travelling path of the textile material M. An electric wave absorber plate 242b is vertically arranged on the opposite side of the travelling path. Even when the microwaves in the chamber 2 leak outside via the slit plate 241, they are almost fully attenuated during their travel through the blocking filter 242. Leakage of the steam in the chamber 2 is minimized extremely well due to the presence of the slit plate 241. A water reservoir 243 is arranged in the proximity of the inlet guide roller 22 below the inner wall 26, which absorbs microwaves surviving even after passage through the blocking filter 242**.

Irradiation of the microwaves should be carried out with the roll being in rotation. In the ordinary case, the irradiation lasts during winding-up of the textile material on the roll and subsequent positive rotation of the roll. This positive rotation may last for 10 to 20 minutes. The irradiation may last during the winding-up of the textile material only. It may also last during the subsequent positive rotation only for 10 to 20 minutes. Choice of the irradiation period is dependent upon the process conditions.

EXAMPLES

Example 1

A textile material in the form of a woven cloth made of an acrylic fiber was dyed in a dye bath of the following composition.

| | |
|---|---|
| Kayacryl Yellow 2RL (C.I. Basic Yellow 67) | 10 g/l |
| Kayacryl Red GRL (C.I. Basic Red 67) | 12 g/l |
| Kayacryl Blue BGL (C.I. Basic Blue 116) | 10 g/l |
| Tio-di-ethylene glycol | 20 g/l |
| Acetic acid | 50 g/l |
| Nonionic penetrant | 2 g/l |

The dyed textile material was squeezed on a padder to 80% pick-up.

Irradiation of microwaves was carried out on the apparatus of the present invention with an output power of 10 KW at a frequency of 2450 MHz for 10 minutes during the subsequent positive rotation of the roll.

Ideal effects were obtained in shade, tone and value, which were all by far better than those obtained by any conventional treatment.

Example 2

A textile material in the form of a woven cloth made of a cellulose fiber was dyed in a dye bath of the following composition.

| | |
|---|---|
| Procion Yellow H3R (C.I. Reactive Orange 12) | 10 g/l |
| Procion Red H3B (C.I. Reactive Red 3) | 12 g/l |
| Procion Blue H-3R (C.I. Reactive Blue 49) | 10 g/l |
| Urea | 100 g/l |
| Sodium carbonate | 30 g/l |

Squeezing and irradiation of microwaves were carried out in manners similar to those in Example 1.

Ideal effects were obtained in shade, tone and value, which were all by far better than those obtained by any conventional treatment.

It was confirmed also that sodium-bi-carbonate could be substituted for sodium carbonate without any lowering in the effects.

Example 3

A textile material in the form of a woven cloth made of wool was dyed in a dye bath of the following composition.

| | |
|---|---|
| Acilan Yellow (C.I. Acid Yellow 9) | 8 g/l |
| Telon Red BLL (C.I. Acid Red 42) | 3 g/l |
| Telon Fast Blue (C.I. Acid Blue 127:1) | 7 g/l |
| Ammonium sulfate | 50 g/l |
| Tio-di-ethylene glycol | 50 g/l |
| Urea | 30 g/l |

Squeezing and irradiation of microwaves were same as those in Example 1, but the latter lasted for 25 minutes.

Excellent effects were obtained in shade, tone and value, which were all by far better than those obtained by any conventional treatment for wool.

Example 4

A textile material in the form of a wooven cloth made of polyamides 6 and 66 was dyed in a dye bath of the following composition.

| | |
|---|---|
| Palatine Yellow ELN (C.I. Acid Yellow 54) | 10 g/l |
| Palatine Red BZN (C.I. Acid Red 214) | 3 g/l |
| Palatine Blue GGN (C.I. Acid Blue 158) | 6 g/l |
| Tio-di-ethylene glycol | 20 g/l |
| Acetic acid | 10 g/l |

Squeezing was same as that in Example 1. Irradiation of microwaves was carried out with an output power of 5 KW at a frequency of 2450 MHz for 15 minutes during the subsequent positive rotation of the roll.

Excellent effects were obtained in shade, tone and value, which were all by far better than those obtained by any conventional treatment.

Example 5

A textile material in the form of a woven cloth made of polyester fiber was dyed in a dye bath of the following composition.

| | |
|---|---|
| Kayalon Polyester Yellow YL-SE (C.I. Disperse Yellow 42) | 10 g/l |
| Kayalon Polyester Red T-S (C.I. Disperse Red 146) | 15 g/l |
| Kayalon Polyester Blue T-S (C.I. Disperse Blue 158) | 15 g/l |
| Sodium Alginate | 2 g/l |

Squeezing was same as that in Example 1. Irradiation of microwaves was carried out with an output power of 8 KW at a frequency of 2450 MHz for 15 minutes during the subsequent positive rotation of the roll.

Excellent effects were obtained in shade, tone and value, which were all by far better than those obtained by any conventional treatment.

I claim:

1. Apparatus for improved aftertreatment of textile material by application of microwaves comprising a preparatory heating chamber arranged on the travelling path of said textile material which said textile material travels through and is provided with means for feeding steam into the interior of said chamber, and an almost confined microwave irradiation chamber arranged on the downstream side of said preparatory heating chamber, said microwave irradiation chamber being provided with means for winding up said textile material into a roll, means for rotating said roll following a programmed sequence, an applicator of said microwaves and means for feeding steam into the interior of said microwave irradiation chamber.

2. Apparatus as claimed in claim 1 further comprising a shelter construction arranged near the inlet of said microwave irradiation chamber for blocking leakage of said steam and microwaves.

3. Apparatus as claimed in claim 2 in which said shelter construction includes a pair of vertical walls defining a space, an adjustable slit plate closing the top of said space whilst allowing passage of said textile material, and a blocking filter arranged within said space which said textile material passes through.

4. Apparatus as claimed in claim 3 in which said blocking filter includes a plurality of electric wave damping elements aligned vertically on the one side of the traveling path of said textile material and a vertically elongated electric wave absorbable plate arranged on the other side of said travelling path.

* * * * *